United States Patent [19]

Gilmore

[11] Patent Number: 4,551,069

[45] Date of Patent: Nov. 5, 1985

[54] INTEGRAL OIL PRESSURE SENSOR

[75] Inventor: Mark R. Gilmore, Troy, Ohio

[73] Assignee: Copeland Corporation, Sidney, Ohio

[21] Appl. No.: 589,325

[22] Filed: Mar. 14, 1984

[51] Int. Cl.[4] ..... F04B 49/02; F04B 49/10; F04B 49/06

[52] U.S. Cl. ..... 417/13; 417/19; 417/38; 417/44

[58] Field of Search ..... 417/13, 19, 38, 44; 418/171, 88

[56] References Cited

U.S. PATENT DOCUMENTS

| | | | |
|---|---|---|---|
| 1,294,497 | 2/1919 | Lovekin | 417/19 |
| 1,603,395 | 10/1926 | Mohl | 417/171 |
| 1,743,585 | 1/1930 | Wiltse | 417/310 |
| 2,390,650 | 12/1945 | Hollatz et al. | 417/13 |
| 2,413,040 | 12/1946 | Elliot | 417/310 |
| 2,441,708 | 5/1948 | Luaces et al. | 417/13 |
| 2,793,803 | 5/1957 | Yerger | 417/13 |
| 2,968,251 | 1/1961 | Eames, Jr. et al. | 418/171 |
| 3,135,460 | 6/1964 | Galin | 418/88 |
| 3,695,791 | 10/1972 | Brundage | 418/171 |
| 3,715,177 | 2/1973 | Woodier | 418/171 |
| 3,716,306 | 2/1973 | Martin | 417/44 |
| 3,796,522 | 3/1974 | Oshima et al. | 418/171 |
| 3,806,273 | 4/1974 | Clark | 417/310 |

FOREIGN PATENT DOCUMENTS

| | | | |
|---|---|---|---|
| 385096 | 12/1932 | United Kingdom | 417/19 |

*Primary Examiner*—William L. Freeh

*Attorney, Agent, or Firm*—Harness, Dickey & Pierce

[57] ABSTRACT

An improved oil pump assembly for a refrigeration compressor is disclosed which includes a sensor located within the oil pump housing which is operative to de-energize the compressor in the event the pressure differential between the inlet and outlet of the oil pump drops below a predetermined level. Pressure sensing communication between the sensor and the inlet is provided via a cutout portion of the gasket between the pump and compressor housing.

4 Claims, 5 Drawing Figures

INTEGRAL OIL PRESSURE SENSOR

Background and Summary of the Invention

The present invention relates generally to lubrication systems and more particularly to lubrication systems for compressors which incorporate means to shut down the compressor in the event of loss of lubricant flow.

Previously in compressors employing a pressure lubrication system it has been the practice to incorporate some type of sensor which may operate to de-energize the compressor in the event of a loss of lubricant flow so as to prevent damage to the compressor. In one form of which applicant is aware, the sensor is mounted externally on the compressor and suitable externally routed tubing is provided to connect the sensor to the oil sump or pump inlet and the pump outlet. In this application, the sensor is responsive to the pressure differential across the oil pump and operates to de-energize the compressor in the event this pressure differential drops below a predetermined minimum.

While such arrangements are effective in preventing damage to the compressor in the event of loss of lubricant flow, they require considerable expense in terms of labor and materials to fabricate and install the external tubing and fittings required thereby. Further, the presence of additional connections as well as the fact this plumbing is exposed to potential damage, either of which give rise to leakage or incorrect readings, makes this arrangement less than ideal.

The present invention, however, incorporates provisions whereby the sensor may be located within the oil pump housing itself and thus eliminates the need for any potential troublesome external plumbing. Passage means are provided integral with the oil pump housing whereby the sensor is able to sense both inlet and outlet pressures and hence respond to the pressure differential created by the oil pump. Thus, the present invention enables the protection against loss of lubricant pressure to be obtained at substantially lower cost in terms of both material and labor and offers improved reliability due to the elimination of multiple connections and external plumbing previously required.

Additional advantages and features of the present invention will become apparent from the subsequent description and the appended claims taken in conjunction with the accompanying drawings.

DESCRIPTION OF THE PREFERRED EMBODIMENT

Figures 1, 2:
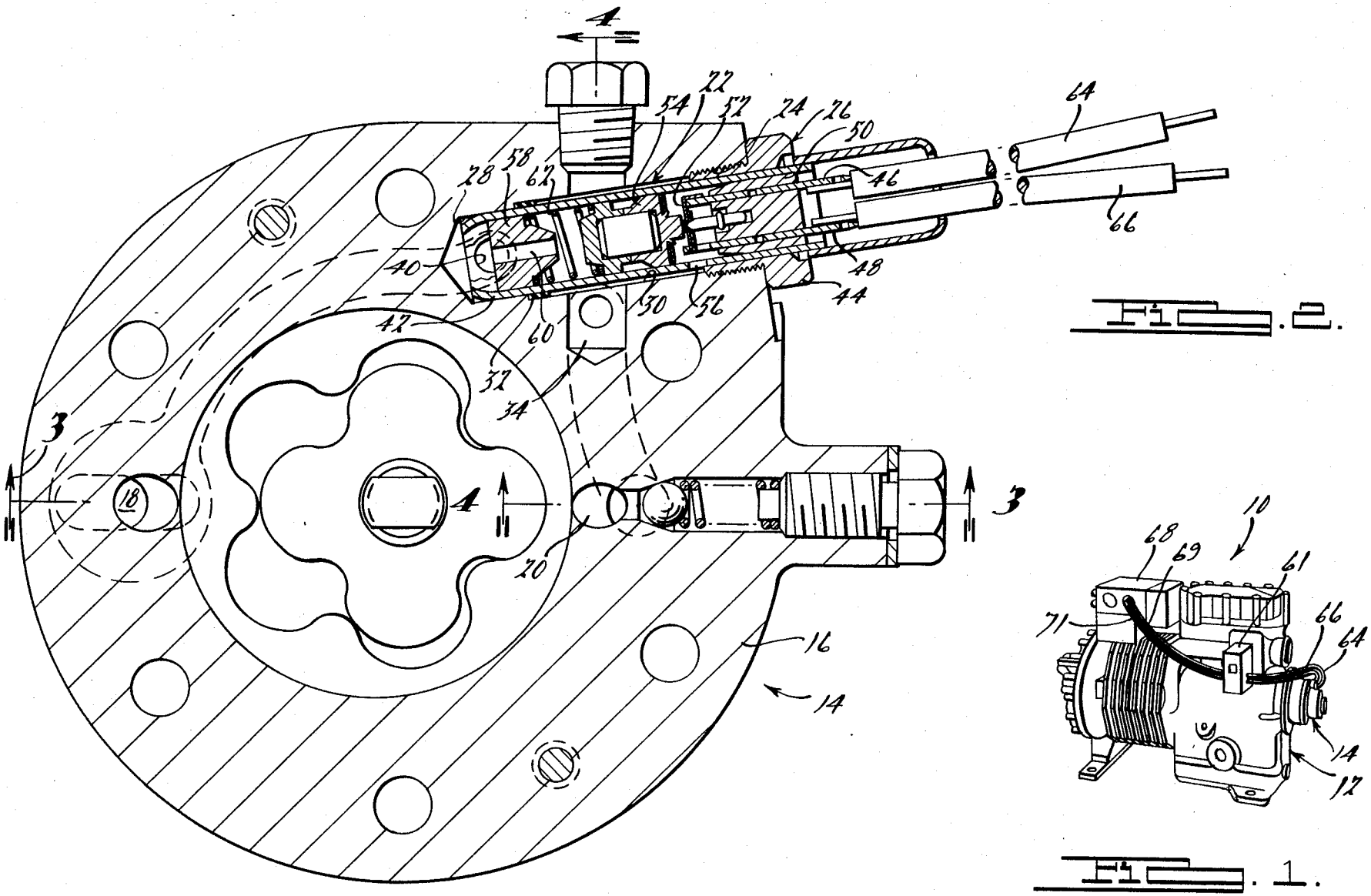
FIG. 1 is a perspective view of an accessible hermetic compressor incorporating the present invention.
FIG. 2 is an enlarged section view of the oil pump assembly incorporated in the compresor of FIG. l.

Referring now to the drawings and in particular to FIG. 1, there is shown an accessible hermetic refrigeration compressor 10 having a compressor housing 12 within which is disposed a motor drivingly connected to compressor means and a lubricant sump containing a supply of lubricant in the lower portion thereof. An oil pump assembly 14 in accordance with the present invention is secured to one end of the housing and is also adapted to be driven by the motor.

Figure 3:
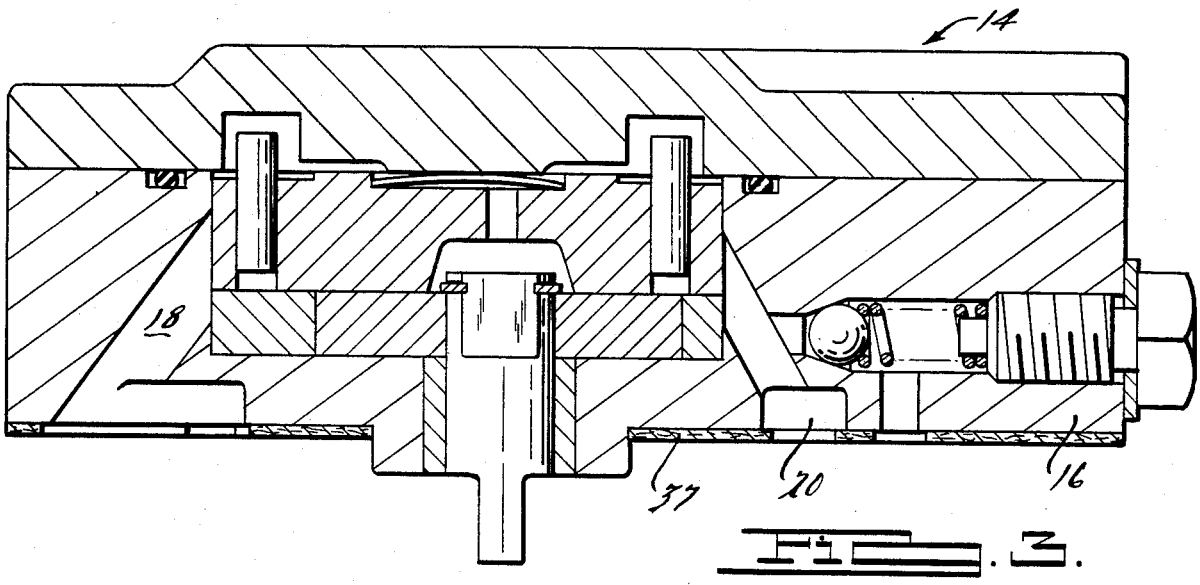
FIG. 3 is a section view of the assembly of FIG. 2, the section being taken along the line 3-3 thereof.
Figure 4:
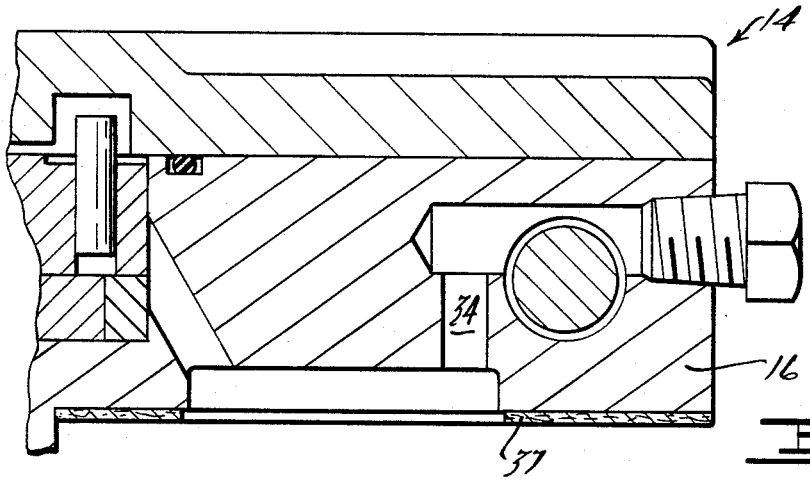
FIG. 4 is a fragmentary section view of the assembly of FIG. 2 showing the outlet passage arrangement, the section being taken along line 4—4 thereof.

As best seen with reference to FIGS. 2–4, oil pump assembly 14 comprises a pump housing 16 within which is disposed a standard oil pump of the gerrotor type which operates to draw lubricant from the sump via a suction inlet passage 18 provided in the housing 16 and to discharge lubricant under pressure through a discharge passage 20 in the housing 16.

A bore 22 is provided extending into the oil pump housing from the circumference thereof the outer end 24 of which is threaded to receive a pressure differential sensor 26. A reduced diameter inner portion 28 of bore is separated from the outer portion 30 thereof by means of a fluid-tight seal 32 surrounding the sensor 26 and bearing against a shoulder which forms the line of demarcation between the larger diameter outer portion 30 and smaller diameter inner portion 28.

Figure 5:
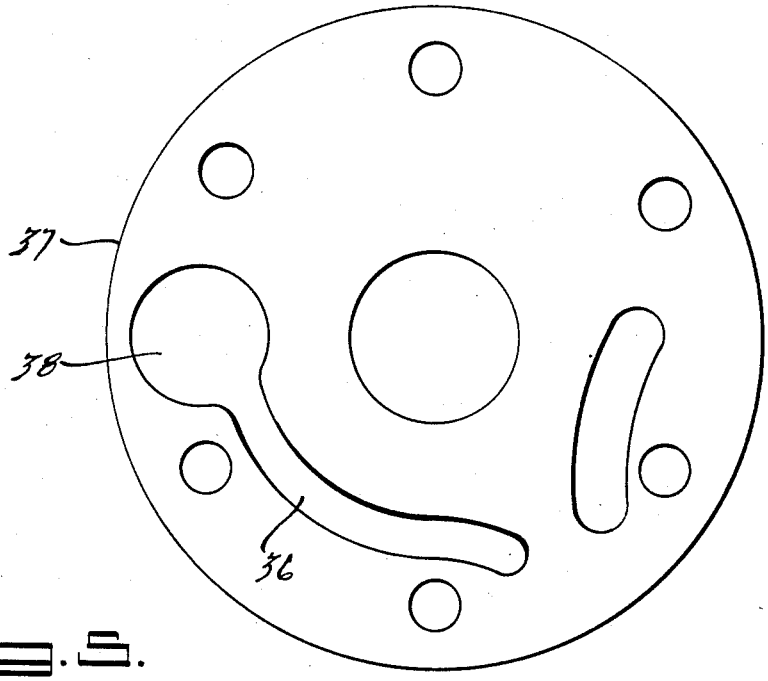
FIG. 5 is a plan view of the gasket interposed between the oil pump housing and compressor housing which also defines the passage for lacing the sensor in communication with the compressor inlet.

In order to place the sensor in fluid communication with the outlet of this oil pump, a passageway 34 is also provided extending from the outer portion of bore 22 to the discharge outlet 20 of the pump 14. A second passage 36 extends from the suction inlet 18 of the oil pump 14 to the inner end of bore 22 and operates to place sensor 26 in communication with the oil pump inlet 18. As best seen with reference to FIG. 5, this second passage 36 is defined in part by a generally arcuately shaped cutout portion in a gasket 37 which is positioned between the compressor housing 12 and oil pump assembly 14. As shown, this cutout portion extends from a generally circular area 38 surrounding the oil pump inlet 18 to a generally axially extending bore 40 in the pump housing 16 which opens into the inner end of bore 22.

As best seen with reference to FIG. 2, pressure sensor 26 comprises an elongated cylindrical tube 42 sealingly fitted within a threaded fitting 44. A pair of relatively rigid electrical conductors 46 and 48 extend through a sealing insulating medium 50 which closes the outer end of the tube and are interconnected by a movable contact arm 52 secured to one arm 46 and normally movably biased into a closed position engaging the other conductor 48. A piston 54 is movably positioned within the tube 42 and separates the interior of the tube into a high pressure portion which communicates with the discharge 20 of the oil pump 14 via port 56 in the sidewall of tube and a low pressure portion which communicates with the suction 18 of the oil pump 14 via port 60 extending through stop member 58 positioned in the end of tube 42. Stop 58 also provides a seat for spring 62 which operates to bias piston 54 into engagement with contact arm 52 so as to move contact arm out of engagement with conductor 48 and hence into an open position. Sensor 26 is interconnected with the motor power supply via an electronic control module 61. The purpose of module 61 is to provide a manual reset mechanism for use after compressor stoppage initiated by sensor 26 as well as to provide a time buffer between sensor 26 switching and compressor shutdown. Connection between sensor 26 and module 61 is accomplished by a pair of electrical leads 64 and 66. Module 61 is connected with the motor power supply contactor located within box 68 via electrical leads 69 and 71. By these means sensor 26 may operate to de-energize the drive motor in the event of a reduction in the sensed pressure differential across the oil pump 14 which in turn signifies a reduction or loss of lubrication to the compressor.

During normal operation, the higher pressure on the discharge side of the oil pump 14 will be transmitted through passage 34 and port 56 and operate to move piston away from contact arm 52 thereby maintaining a normally closed circuit. However, should the pressure differential across the oil pump decrease for whatever reason to a level less than that necessary to overcome the biasing action of spring 62, piston 54 will move into engagement with contact arm 52 and move it out of engagement with conductor 48 thereby signaling the control module 61 to de-energize the motor means thereby reducing the possibility of damage to the compressor as a result of loss lubricant.

It should be noted that the specific physical configuration of the oil pump assembly as shown herein is exemplary only and may vary depending upon the specific requirements and configurations of the compressor with which it is to be utilized.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

I Claim:

1. A pressure lubrication system for a refrigeration compressor comprising:

a compressor housing;

compressor means within said housing;

motor means within said housing and drivingly connected to said compressor means;

lubricant pump means drivenly connected to said motor means, said pump means being operative to supply lubricant to said compressor means and including a housing having an inlet and an outlet, said inlet communicating with a fluid reservoir which is subject to wide pressure differentials; and self-contained sensor means removably positioned within said pump housing and passage means within said pump housing for placing said sensor means in communication with said inlet and said outlet, said sensor means being operative to de-energize said motor in response to a sensed differential condition between said inlet and outlet outside of a predetermined range.

2. A pressure lubrication system as set forth in claim 1 wherein said sensor communicates with said pump inlet and outlet via internal passage means.

3. A pressure lubrication system as set forth in claim 1 wherein said pump housing is secured to said compressor means with gasket means interposed therebetween and said gasket means defines a flowpath between said inlet and said sensor means.

4. A pressure lubrication system as set forth in claim 3 wherein said flowpath defined by said gasket means comprises a cutout extending from said inlet to said sensor.

* * * * *